United States Patent [19]

Neuhouser

[11] Patent Number: 4,484,046

[45] Date of Patent: Nov. 20, 1984

[54] VACUUM LOAD BREAK SWITCH

[75] Inventor: Don E. Neuhouser, Point Pleasant, W. Va.

[73] Assignee: Power Distribution Products, Inc., Point Pleasure, W. Va.

[21] Appl. No.: 458,020

[22] Filed: Jan. 14, 1983

[51] Int. Cl.[3] ..... H01H 33/66

[52] U.S. Cl. ..... 200/144 B; 200/145; 200/146 R

[58] Field of Search ..... 200/144 R, 144 A, 144 B, 200/144 C, 144 AP, 145, 146 R, 146 A, 146 AA, 50 C, 50 AA; 307/326

[56] References Cited

U.S. PATENT DOCUMENTS

| | | | |
|---|---|---|---|
| 2,480,622 | 8/1949 | Warnock | 200/146 R |
| 2,919,316 | 12/1959 | Schrameck et al. | 200/50 C |
| 3,070,680 | 12/1962 | McBride et al. | 200/146 R |
| 3,560,682 | 2/1971 | Kohler et al. | 200/144 B |
| 3,571,543 | 3/1971 | Perkins et al. | 200/144 B |
| 3,588,410 | 6/1971 | Guraydin et al. | 200/144 X |
| 3,590,186 | 6/1971 | Brunner | 200/144 B X |
| 3,603,752 | 9/1971 | Frink | 200/50 AA |
| 3,671,696 | 6/1972 | Brunner | 200/144 B |
| 3,814,881 | 6/1974 | Cherry et al. | 200/144 B |
| 3,823,288 | 7/1974 | Wilson | 200/144 B |
| 3,824,359 | 7/1974 | Date | 200/146 R |
| 3,883,709 | 5/1975 | Cole | 200/144 B |
| 4,104,496 | 8/1978 | Kolka et al. | 200/144 B |
| 4,130,850 | 12/1978 | Cromin et al. | 200/144 B X |
| 4,220,837 | 9/1980 | Bice | 200/146 R |

*Primary Examiner*—A. D. Pellinen
*Assistant Examiner*—Morris Ginsburg
*Attorney, Agent, or Firm*—Cushman, Darby & Cushman

[57] ABSTRACT

A vacuum load break switch uses a vacuum interrupter for the load break device together with a series connected visible disconnect which is interlocked with the vacuum interrupter mechanism. Further, the visible disconnect is grounded in the fully opened switch position. A manual switch operator is provided together with interconnect means interconnecting the manual switch operator to both the visible disconnect switch means and the vacuum interrupter in a manner such that in a switch closing operation of the manual switch operator the visible disconnect switch means closes before the vacuum interrupter means and in an opening operation the vacuum interrupter means opens before the visible disconnect switch means. Additionally, an additional solenoid operated switch operator is coupled to the interconnect means for opening the vacuum interrupter through solenoid action.

7 Claims, 8 Drawing Figures

FIG. 8
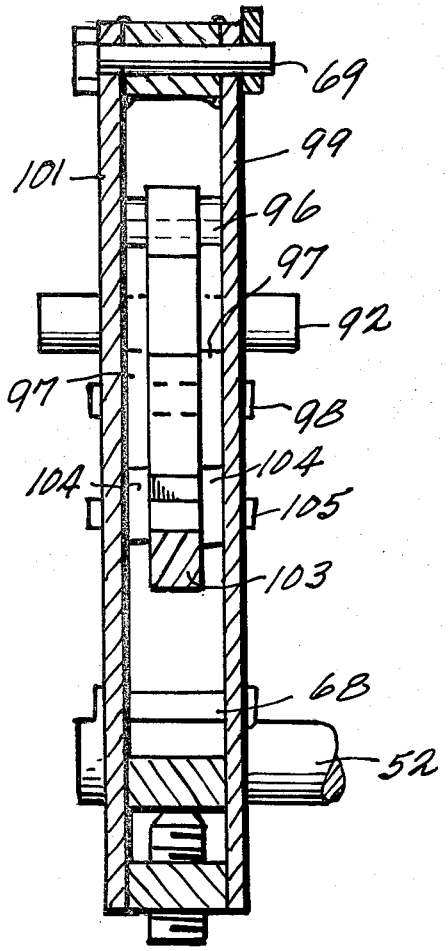
FIG. 7
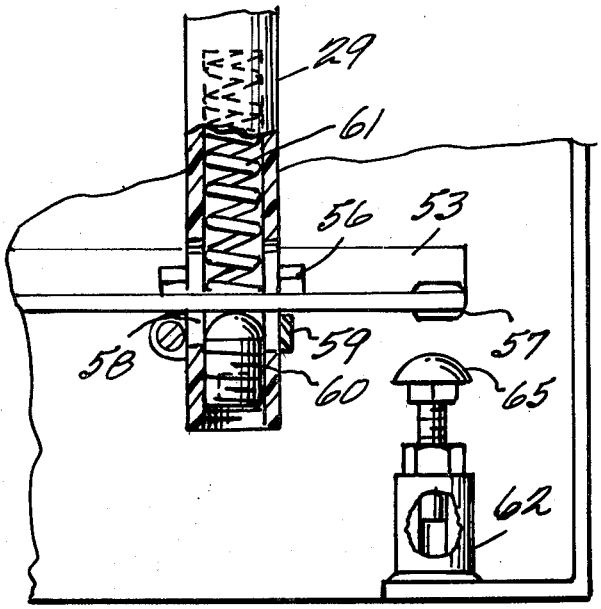
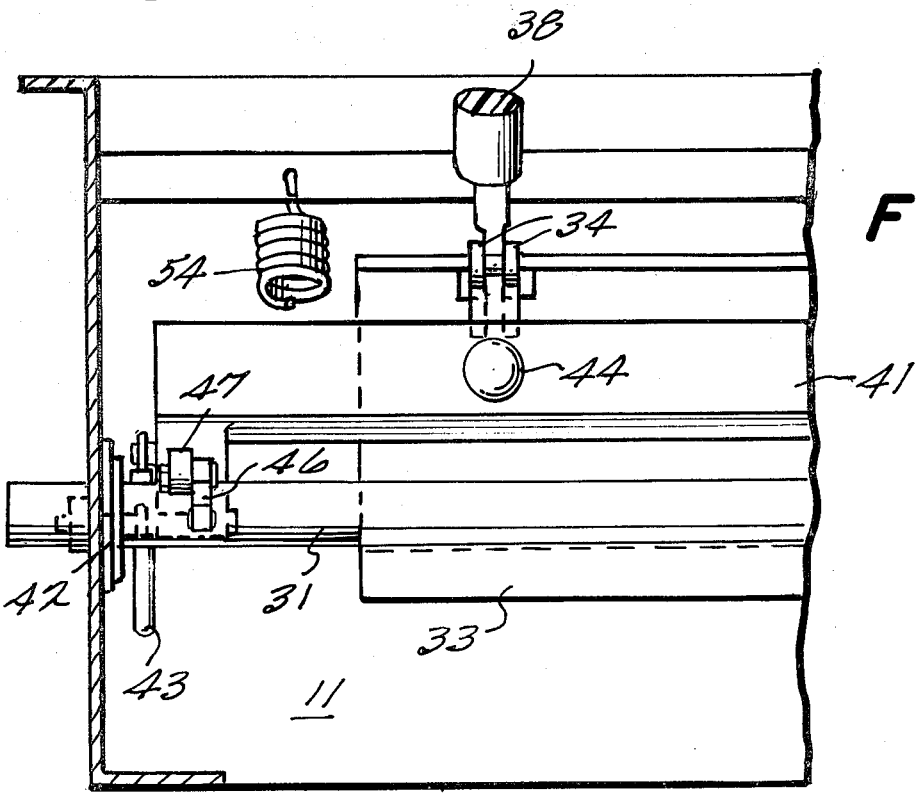
FIG. 6

VACUUM LOAD BREAK SWITCH

BACKGROUND OF THE INVENTION

This invention pertains to a vacuum load-break switch having a unique combination of features.

Vacuum interrupters have been used for load-break switches in the prior art, but not with a groundable disconnect switch in series. Circuit breakers use a different type of vacuum interrupter, can be opene load-break device. One important reason for using vacuum interrupters is their ability to interrupt full load current twenty thousand times while ordinary loadbreak switches will interrupt rated current a maximum of one hundred times.

The vacuum interrupters used for load-break applications cannot interrupt the high levels of current required for circuit breakers. However, the circuit breaking vacuum interrupters cause voltage transients and the system must be protected against the transients. Also, the cost of the circuit-breaking type of vacuum interrupter is several times that of the load-break type vacuum interrupter.

OBJECTS AND SUMMARY OF THE INVENTION

It is an object of the present invention to provide a high voltage vacuum load break switch having an automatic grounding feature.

It is another object of this invention to provide a high voltage vacuum load break switch using a vacuum interrupter for the load-break device together with a series connected visibledisconnect interlocked with the interrupter mechanism.

It is still a further object of this invention to provide such a high voltage vacuum load break switch in which the visible disconnect is grounded in the fully open switch position.

It is still a further object of this invention to provide a vacuum load break switch in which the vacuum interrupters can be opened electrically by a solenoid.

It is still a further object of this invention to provide such a high voltage vacuum load break switch having a simple tripping mechanism.

Briefly, in accordance with one embodiment of the invention, a vacuum load break switch is provided which includes support means having first, second and third spaced apart insulator support members mounted thereon. The switch includes first, second and third electrically conductive terminals respectively affixed to one end of the respective insulator support members. Visible knife blade switch means are provided extending between the first and second conductive terminals, and vacuum interrupter means are electrically connected between the second and third conductive terminals so that the visible knife switch means and the vacuum interrupter means are connected in series. A manual switch operator is mounted on the support means and a grounding member is mounted on the support means and electrically connected to ground. Interconnect means are provided for interconnecting the manual switch operator to both the visible knife switch means and the vacuum interrupter means in a manner such that in a switch closing operation of the manual switch operator the knife switch means closes before the vacuum interrupter means, and in an opening operation the vacuum interrupter means opens before the visible knife switch means. The grounding member is mounted in such a position that the visible knife switch means contacts same when in the fully open position to connect the visible knife switch means to ground.

Other objects and advantages of the present invention will appear from the detailed description of the preferred embodiment taken in connection with the accompanying drawings.

BRIEF DESCRIPTION OF THE DRAWINGS

FIG. 6 is a sectional view taken along the line 6—6 of FIG. 4.

FIG. 7 is a sectional view taken along the line 7—7 of FIG. 4.

FIG. 8 is a sectional view taken along the line 8—8 of FIG. 5.

DETAILED DESCRIPTION

Figure 1:
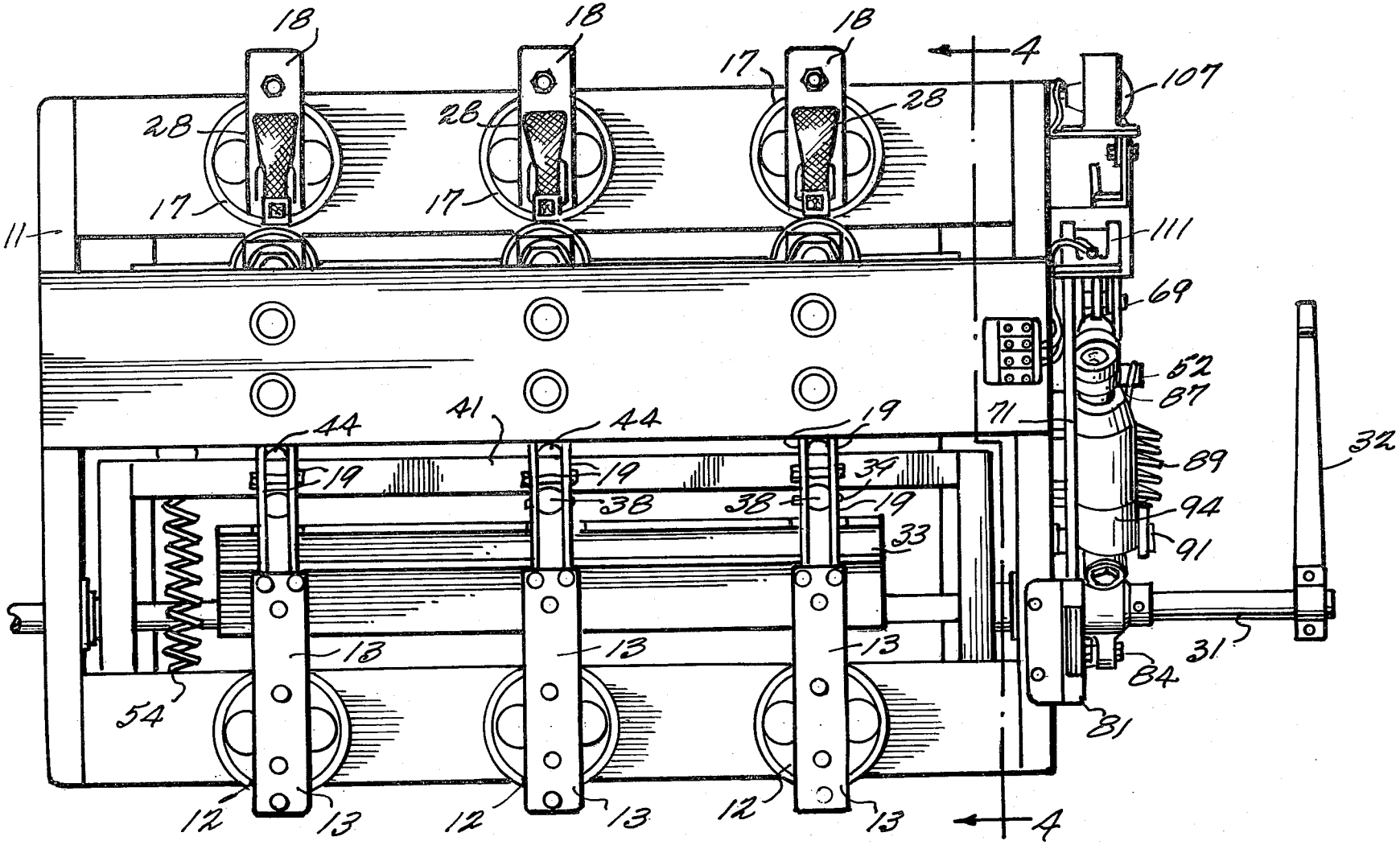
FIG. 1 is a top plan view of a vacuum interrupter load break switch in accordance with the present invention.
Figure 2:
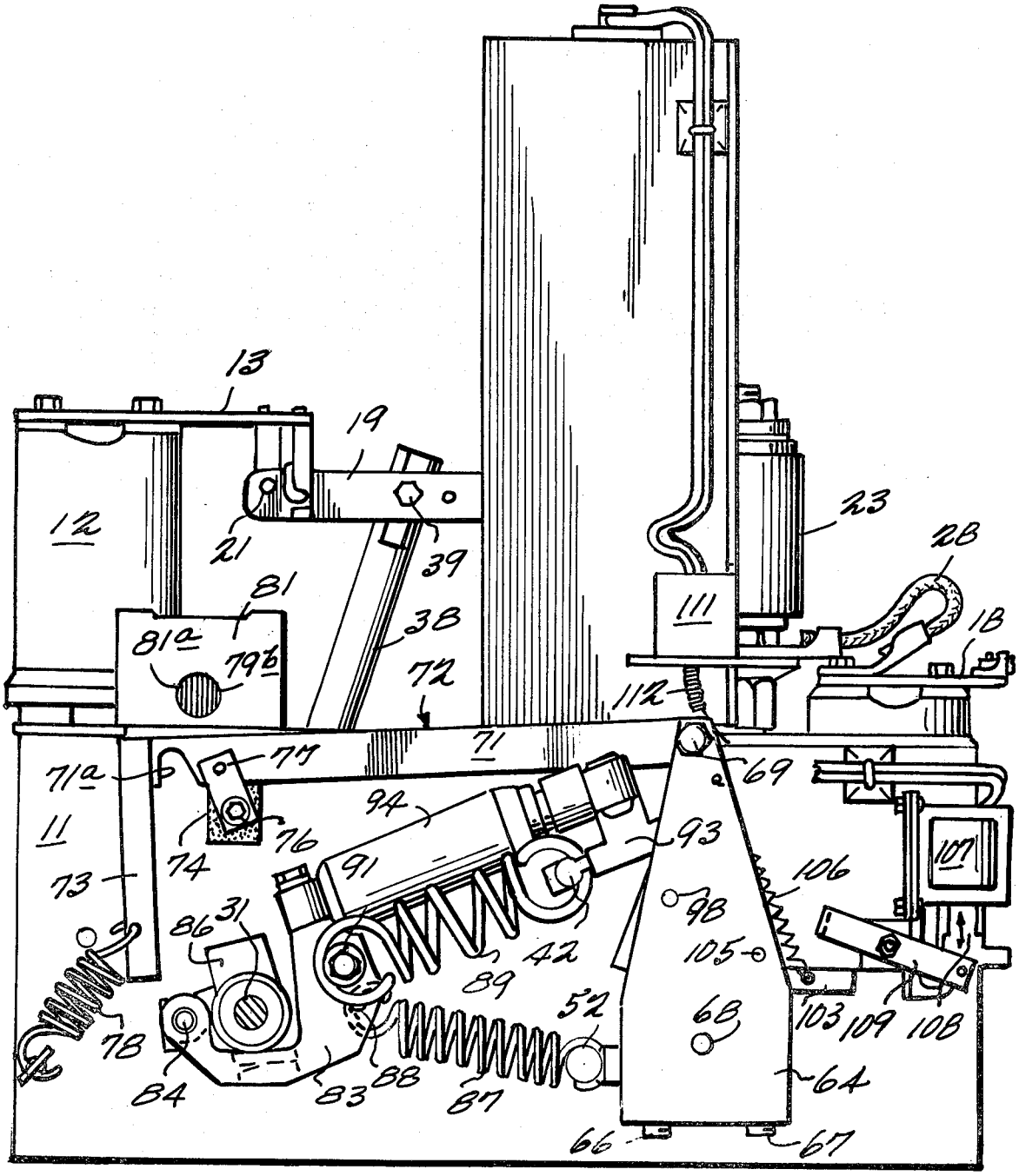
FIG. 2 is a side elevation of the vacuum load break switch of the present invention showing the load break switch in a closed position.
Figure 4:
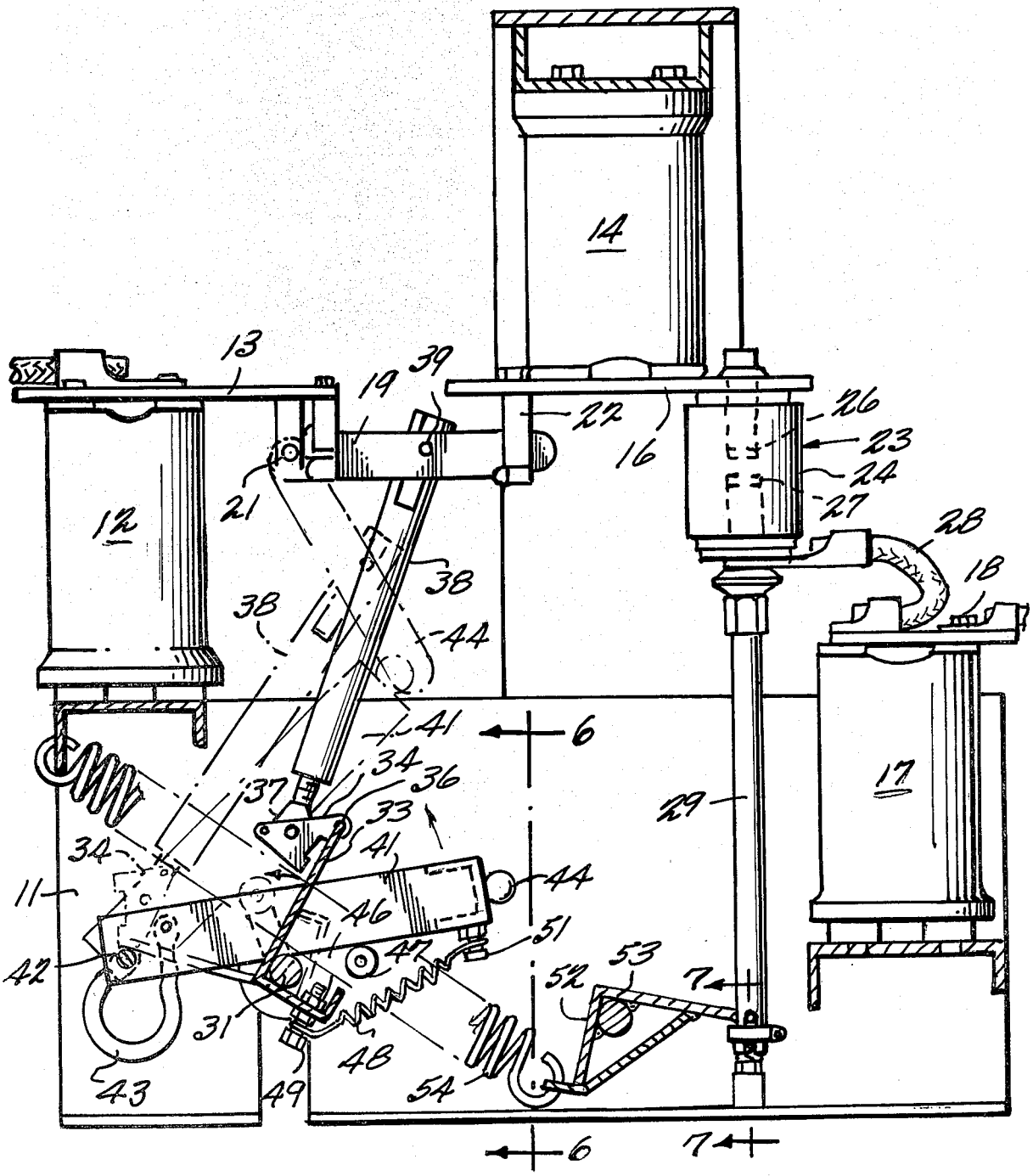
FIG. 4 is a sectional view of the load break switch taken along line 4—4 of FIG. 1.

Turning now to a consideration of FIGS. 1 and 2, the vacuum load break switch of the present invention includes a suitable frame or support means 11. A first group of insulator supports 12 are provided mounted to the frame 11. Three of the insulator support members 12 are provided, one for each phase of a three phase electrical circuit. Mounted to each of the insulator support members 12 are respective electrically conductive terminals 13. A second group of insulator support members 14 are also provided mounted to the frame means 11 (see FIG. 4). The insulator support members 14 have electrically conductive terminals 16 affixed thereto as shown in FIG. 4. A third group of insulator support members 17 are also provided mounted to the support or frame 11, and each of the insulator support members 17 has an electrically conductive terminal 18 affixed thereto.

As most clearly shown in FIG. 4, visible switch means generally indicated by reference numeral 19 are provided extending between each of the electrically conductive terminals 13 and 16. The visible switch means 19 each comprise a pair of knife blades suitably pivoted at pivot 21 on electrically conductive terminal 13. The knife switch blades 19 engage and disengage from blade jaw assembly 22 mounted on electrically conductive terminal 16 to make and break electrical connection between the electrically conductive terminals 13 and the electrically conductive terminals 16.

As shown in FIG. 4, a vacuum interrupter 23 is provided mounted to each of the electrically conductive terminals 16. Each of the vacuum interrupters 23 includes an evacuated envelope 24, a stationary contact 26, and a reciprocally movable contact 27. The reciprocally movable contact 27 of the vacuum interrupter is connected by a conductor 28 to the electrically conductive terminal 18. When the contacts 26 and 27 of vacuum interrupter 23 are open as shown in FIG. 4, the electrical circuit between terminals 16 and 18 is open; when the contacts 26 and 27 are closed the electrical circuit between terminals 16 and 18 is closed. The reciprocally movable contact 27 of vacuum interrupters 23 is reciprocated between open and closed positions by reciprocating movement of a rod 29. The manner in which this occurs is more fully discussed hereafter.

A main operating shaft 31 is provided suitably mounted in the frame 11 for rotation with respect thereto. A manual operating lever 32 is suitably fixed to the main operating shaft 31. Interconnect means are provided for interconnecting the operating shaft 31 to both the visible knife switch means 19 and the vacuum interrupters 23. The various components and assemblies of the interconnect means are described hereafter. The principle behind the present invention is that when the vacuum load break switch is closed and is to be opened, rotation of the shaft 31 first causes a "snap-action" opening of the vacuum interrupters 23, followed by opening of the visible knife switch means 19 upon continued rotation of the shaft 31. Conversely, when the vacuum load break switch of the present invention is open and is to be closed, rotation of the operating shaft 31 in an opposite direction first causes the visible knife switch means 19 to be closed between the electrically conductive terminals 13 and 16, with continued rotation of the operating shaft 31 causing a "snap-action" closing of the contacts within the vacuum interrupters 23.

First, that portion of the interconnect means coupling motion of the operating shaft 31 to open and close the visible knife switch means 19 will be described. Referring to FIG. 4, the main operating shaft 31 has an L-shaped bracket 33 fixedly secured thereto. Lost-motion links 34 have one end pivotally mounted to the bracket 33 at pivot point 36. The other end of each lost motion link 34 is pivotally attached at a pivot point 37, to one end of a push rod 38. The other ends of push rods 38 are pivotally connected by pivot point 39 to the central portion of the visible knife switches 19, all as shown in FIG. 4.

Upon rotation of the operating shaft 31 in a switch opening direction (counterclockwise in FIG. 4), while operating shaft 31 displaces the bracket 33 through a predetermined angle, the motion is taken up by the lost motion links 34 so that the push rods 38 merely pivot about the pivot point 39 and the visible knife switch contacts 19 remain closed. Upon further movement of the operating shaft 31 and the bracket 33, the lost motion links 34 are fully extended. Continued rotation of the operating shaft 31 and the bracket 33 displaces the push rods 38 downward to open the visible knife switch means 19. The fully opened position of the knife switch means 19 is illustrated by phantom lines in FIG. 4, showing the position assumed by the bracket 33, lost motion links 34, push rods 38 and knife switch means 19.

In accordance with a preferred embodiment of the invention, means are provided to ground the knife switch means 19 when they are in an open position. Referring again to FIG. 4, a grounding bar 41 is provided suitably attached at pivot point 42 to the frame or support means 11. The grounding bar 41 is connected to frame ground by a conductor 43. The end of the grounding bar 41 opposite the pivot point 42 is provided with grounding members 44 which, in accordahce with one embodiment of the invention, are provided in the form of brass balls.

An arm 46 is suitably rigidly attached at one end to the operating shaft 31 and carries a roller assembly 47 at its other end. The grounding member bar 41 rides on the roller assembly 47. As the operating shaft 31 is rotated towards an open position (counterclockwise in FIG. 4), the arm 46 is rotated and grounding bar 41 is rotated about its pivot point 42 up to a position where the grounding members 44 will make contact with the knife blades of the visible knife switch 19 in the open position. A spring 48 is provided extending between a screw 49 mounted to the L-shaped bracket 33 and a screw 51 mounted to the grounding bar 41 for spring biasing the grounding bar 41 into contact with the roller 47. In FIG. 4, the position of the grounding bar in the fully open switch position, where the grounding members 44 contact the open knife switch means 19 to ground same is indicated in phantom lines.

As shown in the drawings, and in particular FIG. 4, a vacuum interrupter operating shaft 52 is provided suitably mounted to the frame 11 for rotation with respect thereto. A generally L-shaped bracket 53 is provided fixedly mounted to the vacuum interrupter operating shaft 52 for rotation therewith. A spring 54 is connected between one end of the bracket 53 and the frame 11.

The bracket 53 is provided with slots 56 and with an integral round rod 57 extending along the lip of the bracket 53 along its length, including extending across the slots 56. The push rods 29 are also provided with a slot 58 at their end, configured so that the push rods extend into the slots 56 in bracket 53 with the slot 58 in the end of the push rod 29 extending around the round rod 57 at the slots 56 in bracket 53. In order to secure the attachment of the push rods 29 to the bracket 53 clamp members 59 are provided extending around the push rods 29.

As can be seen by referring to FIG. 7, each of the push rods 29 has a spring 61 provided therein extending between round rod 57 and into the push rod 29. The springs are preloaded to minimize the required travel of the push rods. The spring 61 function as "wipe" springs and upon opening the vacuum interrupters 23 serve to help accelerate the mass of the reciprocal contact 27 as well as break loose any contact welding between the contacts 26 and 27. A set screw 60 is provided for adjustment, and a stop 65 mounted to a boss 62 limits travel of bracket 53.

Figure 5:
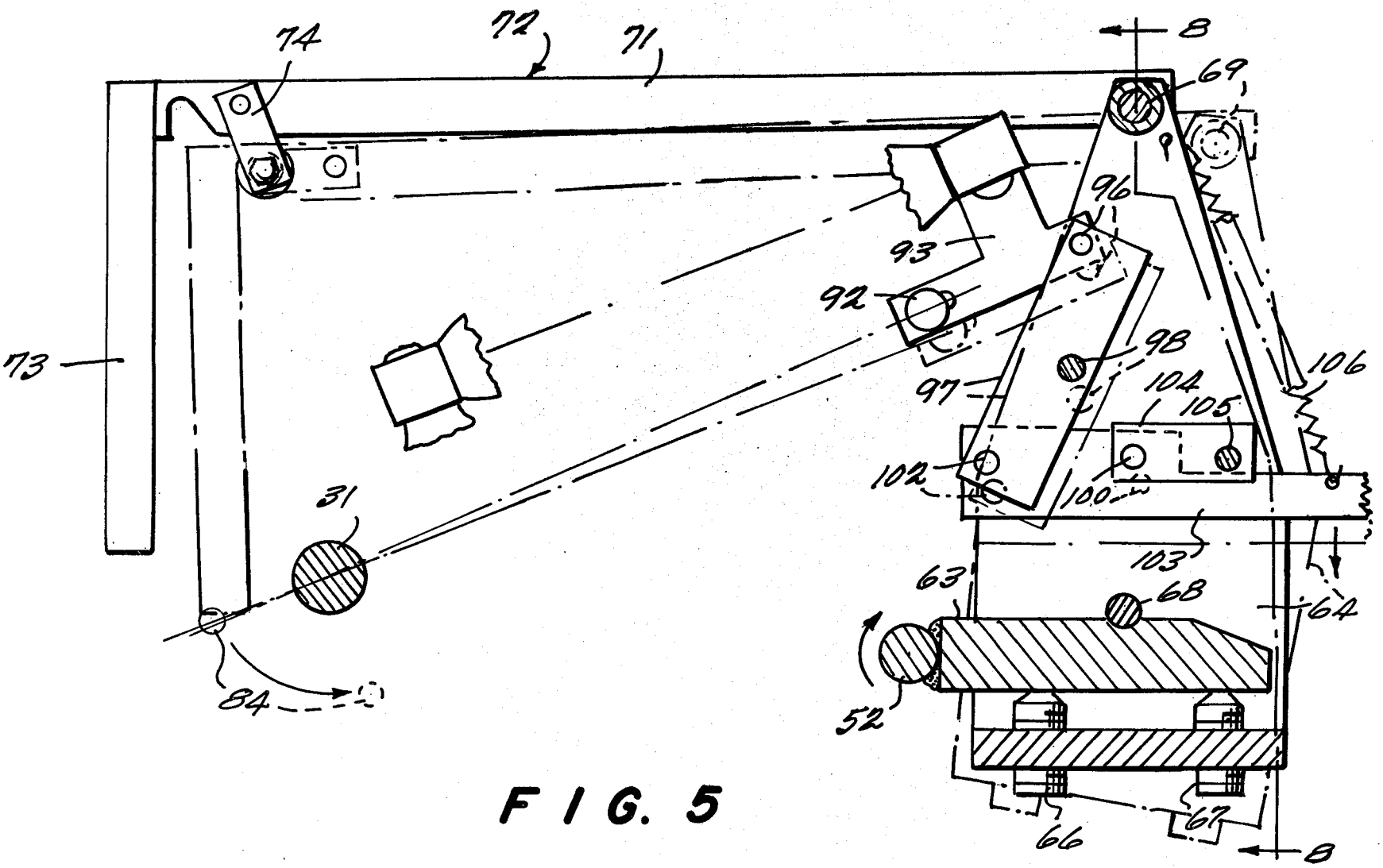
FIG. 5 is a diagrammatic view of a portion of the trigger mechanism used to achieve snap action closing and opening of the vacuum interrupters.

The interconnect and trigger mechanism through which movement or rotation of the main operating shaft 31 is appropriately coupled to the vacuum interrupter operating shaft 52 in order to achieve snap action opening and closing thereof, will now be described with particular reference to FIGS. 2, 3 and 5. A mounting bar 63 is fixedly secured to the vacuum interrupter operating shaft 52, as by welding (see FIG. 5). A trigger assembly 64 is attached to the mounting bar 63 by set screws 66 and 67. By mounting the trigger assembly 64 to the mounting bar 63 through means such as the set screws, the positioning of the trigger assembly 64 with respect to the vacuum interrupter operating shaft 52 can be simply adjusted so as to maintain proper orientation of the trigger assembly 64, without the necessity for having to maintain close tolerances on all parts during manufacture. The set screws 66 and 67 locate the trigger assembly 64 against the mounting bar 63 by means of a detent in the mounting bar 63 cooperating with the pin 68 of trigger mechanism 64. Attached to the top end of the trigger assembly 64 at a pivot 69 is an arm 71 of a governor assembly 72. The governor assembly 72 also has a downwardly depending arm 73. A link 74 is provided with one end thereof pivotally mounted at pivot 76 to the frame or support means 11. The other end of link 74 is pivotally attached at pivot 77 to the arm 71 of governor assembly 72, as shown in the drawings. The arm 71 of the governor assembly has a detent 71*a* as shown in the drawings. The arm 73 of the governor assembly 72 has a spring 78 extending from arm 73 to an attachment point on the frame 11.

The governor assembly 72 is displaceable between two different positions. FIG. 2 shows the governor assembly 72 in a first position that corresponds to the load break switch being in a closed state, and FIG. 3 shows the governor assembly 72 in a second position that corresponds to the load break switch being in an open state.

Figure 3:
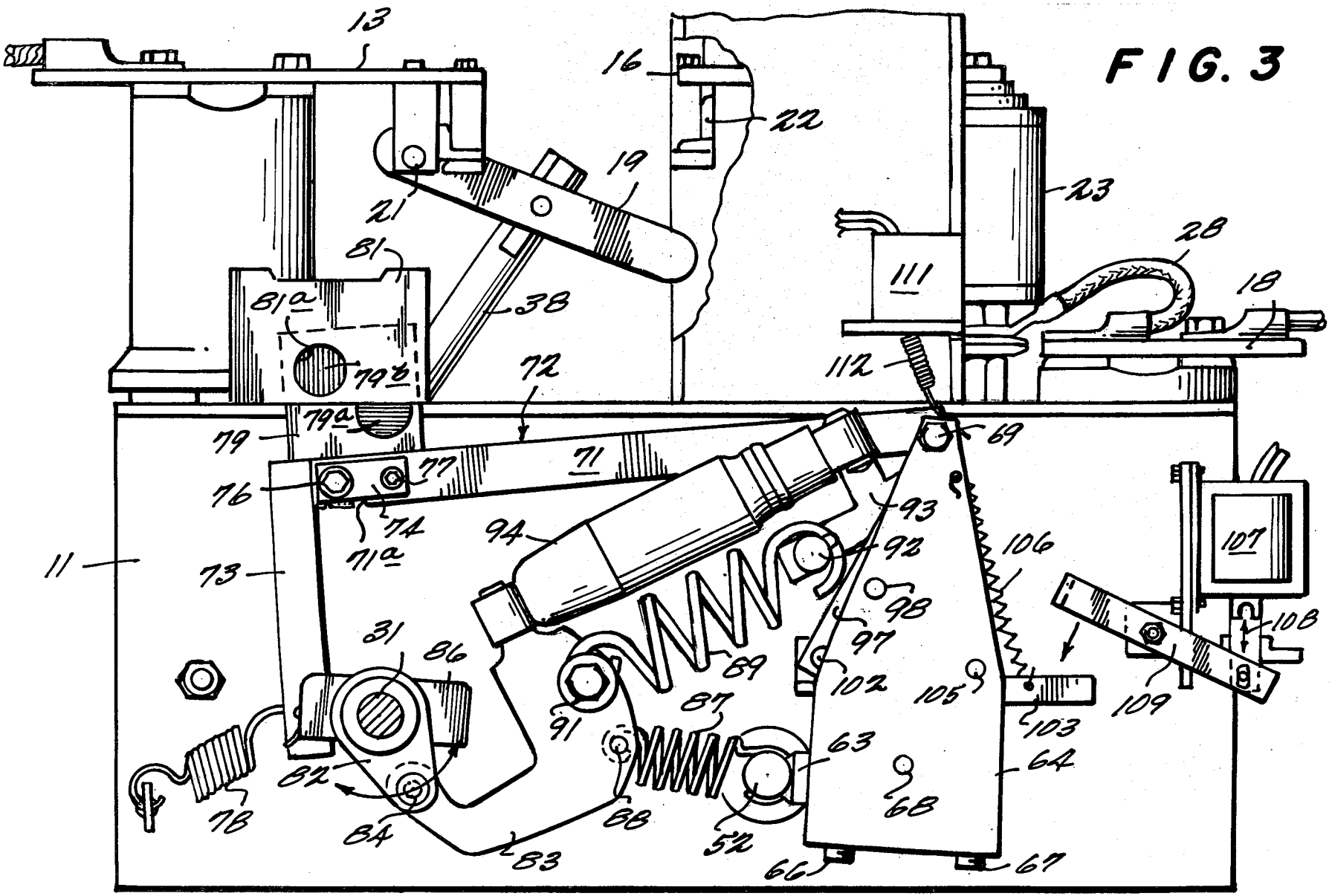
FIG. 3 is a side elevation of the vacuum load break switch of the present invention partially broken away and showing the load break switch in an open position.

Attached to the arm 71 of the governor assembly 72 is an indicator member 79, which may be provided with two color coded indications thereon, shown in FIG. 3 as colored circles 79*a* and 79*b*. An indicator plate 81 is provided as part of the frame 11 having an indicator window 81*a* therein. The positioning of the color circles 79*a* and 79*b* on the indicator member 79 is such that one or the other of the color coded indicator circles appears in the window 81*a* of indicator plate 81 in dependence upon whether the governor assembly 72 is in the first or second position. Thus, by way of example, in the first position of FIG. 2 a red indication appears in the window 81*a*, whereas in the second position of FIG. 3 a green indication appears in the window 81*a*. These color coded indications serve as a visible indication of whether the vacuum load break switch is open or closed.

A ring 82 having an arm portion extending therefrom is pivotally mounted to the main operating shaft 31. An over center link 83 has its one end pinned by a pin 84 to the arm portion of ring 82 as shown in FIG. 3. The pin 84 mounts the link 83 for pivotal movement with respect to the ring 82. The pin 84 also extends outwardly from ring 82 a sufficient amount so that it can be contacted by a bar 86 fixedly secured (as by welding) to the main operating shaft 31. An opening spring 87 is attached between a pin 88 on the link 83 and the vacuum interrupter operating shaft 52. Closing springs 89 are also provided extending between a screw 91 on the link 83 and a spring attachment bar 92. The spring attachment bar 92 is provided on a T-shaped member 93 forming part of the trigger assembly 64. In a preferred embodiment of the invention, two of the closing springs 89 are provided each extending between the bolt 91 and spring attachment bar 92 on either side of the link 83 and T-shaped member 93. A shock absorber 94 is also provided extending between the link 83 and the T-shaped member 93.

The T-shaped member 93 is pinned at one end by a pin 96 to one end of two pivot bars 97. The pivot bars 97 are pivotally pinned by a pin 98 at their middle portion to sidewalls 99 and 101 of the trigger assembly 64 (see FIG. 8). The pivot at pin 98, together with the pivot 69 coupling the top of the trigger assembly to the governor assembly, form the main pivot points for pivoting of the trigger assembly during switch opening and closing.

The pivot bars 97 are pinned at their lower end by a pin 102 to one end of a solenoid trip arm 103. The middle portion of the solenoid trip arm 103 is pinned by a pin 100 to one end of two trip arm pivots 104. The other end of the trip arm pivots 104 are pinned together by a pin 105, which pin serves as a stop for the solenoid trip arm 103. A trip arm return spring 106 extends between the solenoid trip arm 103 and an opening in the sidewalls 99 and 101 of trigger assembly 64.

The operation of the interconnect means interconnecting rotation of the main operating shaft 31 through trigger assembly 64 for snap action rotation of the vacuum interrupter operating shaft 52 will now be described. First, a closing operation will be described. In a manual closing operation the main operating shaft 31 is rotated in a clockwise direction. Such rotation of the main operating shaft 31 causes the bar 86 to contact the pin 84 on ring 82 to displace the ring 82 and the link 83 in a circular arc to the left as shown in FIG. 3. This movement of the link 83 stretches the closing springs 89 with the spring force of springs 89 transferred to the trigger assembly 64 through the T-shaped member 93. This spring force exerted through the T-shaped member 93 to the trigger assembly 64 would normally cause the trigger assembly 64 to rotate, thus rotating the vacuum interrupter shaft 53 to close the vacuum interrupters. However, the governor assembly 72 which is pinned to the top portion of the trigger assembly 64 prevents movement of the trigger assembly 64. The governor arm 72, which is in the position shown by the phantom lines in FIG. 5, prevents any rotation of the trigger assembly 64 until the point where the pin 84 makes contact with the bottom of arm 73 of the governor assembly 72. Pin 84 serves to lift up the arm 73 of the governor assembly which has the function of releasing trigger assembly 64 to move. The stored energy in the closing springs 89 then rapidly pivots the trigger assembly 64 rotating the vacuum interrupter shaft 52 in a snap action fashion. Of course, as previously described, the operating mechanism for the vacuum interrupters is coupled to the vacuum interrupter operating shaft 52, so that this rapid movement serves to close the vacuum interrupters. The closed position of the link 83 is indicated in FIG. 2 and during the closing operation the closing springs 89 also serve to cock the opening spring 87 coupled to the vacuum interrupter operating shaft 52.

During an opening operation, the main operating shaft 31 is rotated in the counterclockwise direction from the position of the various assemblies shown in FIG. 2. This rotation causes the bar 86 welded to the main operating shaft 31 to contact the pin 84 through the arm on ring 82 and presses it downward over-center. As the over-center position is reached and slightly passed the energy in the springs 89 is released suddenly and allows the opening spring 87 to take over. The trigger assembly 64 pivots clockwise through a predetermined angle to achieve snap action rotation of the vacuum interrupter operating shaft 52 to open the vacuum interrupters coupled thereto.

During an initial period of a closing operation rotation of the main operating shaft 31 is sufficient to cause the push rods 38 to close the visible knife switch means prior to the pin 84 touching the bottom of the governor assembly 72 to permit snap action rotation of the trigger assembly 64 to close the vacuum interrupters. Thus, during closing, the visible knife switch means close before the vacuum interrupters close completing the circuit. Conversely, during an opening operation, due to the lost motion links in the coupling between the main operating shaft 31 and the push rods 38, the pin 84 is displaced by the bar 86 to an over center or slightly over center position prior to opening of the visible knife switch means 19. Thus, the trigger assembly 64 is pivoted to achieve snap action rotation of the vacuum interrupter shaft 52 prior to the visible knife switch means 19 opening. Through this arrangement initial opening of the circuit is always achieved by the vacuum interrupters to minimize any arcing. Likewise, final closing of the circuit is also always achieved through the vacuum interrupters also to eliminate arcing. The function of the shock absorber 94 is to control bounce of the vacuum interrupter contacts during closing. Also, the shock absorber 94 serves to maintain alignment and control velocity of the trigger assembly 64, particularly on release when it would tend to fly apart or hammer itself into pieces.

In accordance with a preferred embodiment of the invention, means are also provided to achieve remote operation to open the vacuum interrupters. As described before in connection with FIG. 5, the trigger assembly 64 includes a solenoid trip arm 103 which, together with the trip arm pivots 104, forms a toggle. Referring now to FIG. 3, it can be seen that a solenoid 107 is provided suitably mounted to the frame or support 11. The solenoid 107 has a reciprocal actuator 108 to which is coupled an actuating arm 109. The actuator arm 109 extends over the solenoid trip 103. When the solenoid 107 is actuated the actuator 108 moves upward, pivoting the actuator arm 109 in the direction shown by the arrow in FIG. 3 to contact the solenoid trip arm 103 and displace it downwardly. When the solenoid trip arm 103 is displaced downwardly, the toggle formed by the solenoid trip arm 103 and the trip arm pivots 104 is broken (as indicated by phantom lines in FIG. 5). Breaking of this toggle allows the trigger assembly 64 to pivot due to the spring biasing force of the opening spring 87, which serves to rapidly rotate the vacuum interrupter shaft 52 and achieve snap action opening of the vacuum interrupters. Of course, such solenoid actuation of the vacuum interrupters to open them does not result in any opening of the visible knife switch assemblies 19. After a solenoid vacuum interrupter opening operation, reset of the tripping mechanism is achieved by simply rotating the operating shaft 31 as if opening the vacuum load break switch manually.

In accordance with the preferred embodiment of the invention wherein a solenoid 107 is provided, a microswitch 111 can be provided to remove any power input to the solenoid when the vacuum load break switch is in an open position. Referring to FIGS. 2 and 3, the microswitch 111 controls the application of power to the solenoid 107 and the microswitch 111 has an actuator arm 112. The actuator arm 112 is suitably configured so that when the load break switch is in an open position with the trigger assembly 64 pivoted at its top to the right, the actuator arm 112 is contacted to open the microswitch 11 and prevent application of any power to the solenoid 107. When the trigger assembly 64 is in a position corresponding to the vacuum load break switch being closed as shown in FIG. 2, the top of the trigger assembly 64 is displaced to the left so that the actuator arm 112 is released and the microswitch 111 is closed so that power can be applied to the solenoid 107. This is simply an additional safety feature to remove any power from the solenoid 107 when the vacuum load break switch is in an open condition.

Thus what has been described is a preferred embodiment of a unique load break switch having an advantageous combination of features. These include the use of vacuum interrupters for the load break device along with a visible disconnect interlock with the interrupter mechanism. The visible disconnect, which are knife blades in accordance with the preferred embodiment, are grounded in the fully opened position. In addition to a manual opening operation, the vacuum interrupters can be opened electrically from a remote location through actuation of a solenoid. In addition, a simple trigger mechanism is provided. Although the invention has been particularly described by reference to an exemplary embodiment, it should be clear to those skilled in the art that various modifications are possible to the exemplary embodiment disclosed herein without departing from the true spirit and scope of the invention. It is intended to define the true scope and spirit of the present invention in the appended claims.

I claim:

1. A vacuum load break switch comprising support means having first, second and third spaced apart insulator support members, first, second and third electrically conductive terminals respectively affixed to one end of said insulator support members;, visible knife switch means extending between said first and second conductive terminals, vacuum interrupter means electrically connected between said second and third conductive terminals so that said visible knife switch means and said vacuum interrupter means are connected in series; a manual switch operator mounted on said support means, a grounding member mounted on said support means and electrically connected to ground; interconnect means interconnecting said manual switch operator to both said visible knife switch means and said vacuum interrupter means in a manner such that in a switch closing operation of said manual switch operator, said knife switch means closes before said vacuum interrupter means, and in an opening operation said vacuum interrupter means opens before said visible knife switch means; and said grounding member being mounted such that said visible knife switch means contacts same when in the fully open position to connect said visible knife switch means to ground.

2. A vacuum load break switch in accordance with claim 1 including an additional solenoid operated switch operator coupled to said interconnect means for opening said vacuum interrupter means.

3. A vacuum load break switch in accordance with claim 1 wherein said interconnect means comprises an operating shaft, pushrod means connected to said visible knife switch means for displacing same between open and closed positions, means including a lost motion link coupling the operating shaft to the pushrod means, whereby said lost motion link allows the operating shaft to rotate in the opening direction through a predetermined angle before opening said visible knife switch means.

4. A vacuum load break switch in accordance with claim 3 wherein said interconnect means further includes a vacuum interrupter operating shaft and trigger means for controlling snap action rotation of said vacuum interrupter operating shaft to open and close said vacuum interrupter means.

5. A vacuum load break switch in accordance with claim 4 wherein said trigger means is fixed at one end by adjustable attachment means to said vacuum interrupter operating shaft so that pivotal movement of said trigger means causes rotation of said vacuum interrupter operating shaft, and including a governor assembly and a pivoting link mounting said governor assembly to said support means for movement between first and second positions, the end of said trigger means opposite said one end being pivotally attached to an arm of said governor assembly.

6. A vacuum load break switch in accordance with claim 5 including a ring pivotally mounted to said operating shaft and having an arm, an over center link having a first end pinned to said ring arm with an operating pin extending therefrom, closing spring means coupling a second end of said over center link to said trigger meahs and opening spring means coupling said second end to said vacuum interrupter operating shaft, an operating bar fixedly secured to said operating shaft in a position to make contact with said operating pin extending from said ring arm to displace said over center link between first and second positions, the first position corresponding to a switch closed position and the second position corresponding to a switch opened position, whereby upon rotation of said operating shaft to open said vacuum interrupter means said operating bar contacts said operating pin to move said over center link from said first position toward said second position and when an over center position is reached said opening spring means rapidly displaces said over center link to pivot said trigger means and hence said vacuum interrupter operating shaft to open said vacuum interrupter means, and continued rotation of said operating shaft opens said visible knife switch means and connects same to said grounding member, and whereby upon rotation of said operating shaft to close said load break switch said visible knife switch means are first closed and then said operating bar contacts said operating pin to move said over center link from said second position toward said first position with the movement loading said closing spring means, and said trigger means being prevented from pivoting due to said closing spring means by said governor assembly, and whereby continued rotation of said operating shaft causes said operating pin to contact and displace said governor assembly thereby allowing snap action pivoting of said trigger means and hence said vacuum interrupter operating shaft to close said vacuum interrupter means.

7. A vacuum load break switch in accordance with claim 6 wherein said trigger means also includes a pivoting toggle having a trip arm and means normally biasing said toggle to a closed position, a solenoid having an actuator arm and positioned such that upon actuation of said solenoid said actuator arm contacts and displaces said trip arm to open said toggle and and thereby permit pivoting of said trigger means to rotate said vacuum interrupter operating shaft to open said vacuum interrupter means.

* * * * *